US007672108B2

(12) United States Patent
Moninski et al.

(10) Patent No.: US 7,672,108 B2
(45) Date of Patent: Mar. 2, 2010

(54) FAULT INTERRUPTER AND DISCONNECT DEVICE

(75) Inventors: Joseph P. Moninski, Arlington Heights, IL (US); Henry W. Kowalyshen, Niles, IL (US)

(73) Assignee: S & C Electric Company, Chicago, IL (US)

( * ) Notice: Subject to any disclaimer, the term of this patent is extended or adjusted under 35 U.S.C. 154(b) by 436 days.

(21) Appl. No.: 11/543,289

(22) Filed: Oct. 3, 2006

(65) Prior Publication Data

US 2007/0109694 A1 May 17, 2007

Related U.S. Application Data

(60) Provisional application No. 60/731,300, filed on Oct. 28, 2005.

(51) Int. Cl.
*H01H 73/00* (2006.01)

(52) U.S. Cl. ..... 361/115

(58) Field of Classification Search ..... 361/115, 361/2

See application file for complete search history.

(56) References Cited

U.S. PATENT DOCUMENTS

| | | | | | |
|---|---|---|---|---|---|
| 3,814,878 | A * | 6/1974 | Weston et al. | ..... | 218/7 |
| 4,105,878 | A * | 8/1978 | Date et al. | ..... | 218/10 |
| 5,864,107 | A * | 1/1999 | French et al. | ..... | 200/50.01 |
| 6,002,560 | A * | 12/1999 | Nguyen et al. | ..... | 361/23 |
| 6,040,538 | A * | 3/2000 | French et al. | ..... | 200/293 |
| 6,114,642 | A * | 9/2000 | French et al. | ..... | 200/293 |
| 6,753,493 | B2 * | 6/2004 | Rhein et al. | ..... | 218/120 |

* cited by examiner

*Primary Examiner*—Stephen W Jackson
*Assistant Examiner*—Lucy Thomas

(57) ABSTRACT

A circuit or fault interrupting and disconnect device includes a tripping apparatus that ensures a vacuum interrupter of the device is opened upon initiation of a change of state of an associated disconnect blade assembly. The disconnect blade assembly may have an open state and a closed state. A drive mechanism couples to the blade assembly to move the blade assembly to its various states. The drive mechanism couples to the interrupter trip assembly to provide for opening of the contacts of the vacuum interrupter prior to the blade assembly making or breaking contact.

16 Claims, 5 Drawing Sheets

FAULT INTERRUPTER AND DISCONNECT DEVICE

This application claims the benefit of U.S. Provisional Application No. 60/731,300 filed Oct. 28, 2005.

TECHNICAL FIELD

This patent relates to a fault interrupting device including a circuit interrupter tripping apparatus operable responsive to a change of state of an associated disconnect assembly.

BACKGROUND

Electrical switches and circuit interrupting devices may incorporate various operating mechanisms for placing the switches and circuit interrupting devices in the desired operating state. An interrupter and disconnect assembly, for example, may incorporate a circuit interrupting device in conjunction with a moveable blade assembly. The operating mechanism provides for operation of the blade assembly while a suitable actuator may be provided to operate the interrupter. Typically, load breaking is provided by the circuit interrupting device while load making, including fault reclosing, is accomplished through the blade assembly. The disconnect blades therefore take the burden of load or fault current arcing during a closing operation. This may limit useful life of a blade assembly.

DETAILED DESCRIPTION

A circuit or fault interrupting and disconnect device includes a tripping apparatus that ensures a vacuum interrupter of the device is opened upon initiation of a change of state of an associated disconnect blade assembly. The disconnect blade assembly may have an open state and a closed state. The blade assembly may further have additional states such as a ground state, separate from the open and closed states. A drive mechanism couples to the blade assembly to move the blade assembly to its various states. The drive mechanism may be manually or automatically actuatable to move the blade assembly from one of its states to another of its states. The drive mechanism may further couple to an interrupter trip assembly to provide for opening of the contacts of the vacuum interrupter prior to the blade assembly making or breaking contact.

While the invention is described in terms of several preferred embodiments of circuit or fault interrupting devices, it will be appreciated that the invention is not limited to circuit interrupting and disconnect devices. The inventive concepts may be employed in connection with any number of devices including circuit breakers, reclosers, and the like.

Figure 1:
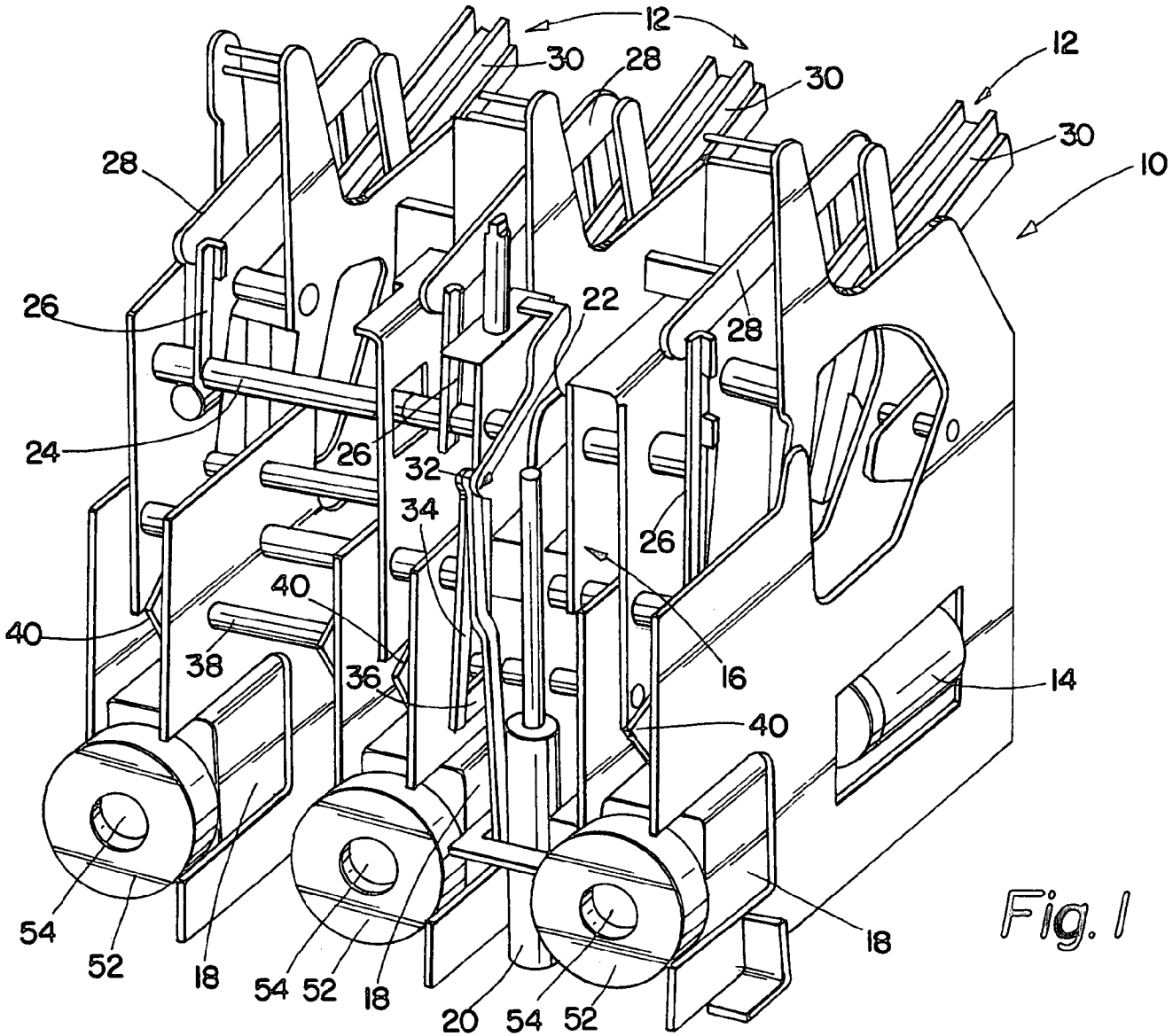
FIG. 1 is a perspective view of multi phase fault interrupter and disconnect assembly in accordance with a described embodiment.
Figure 2:
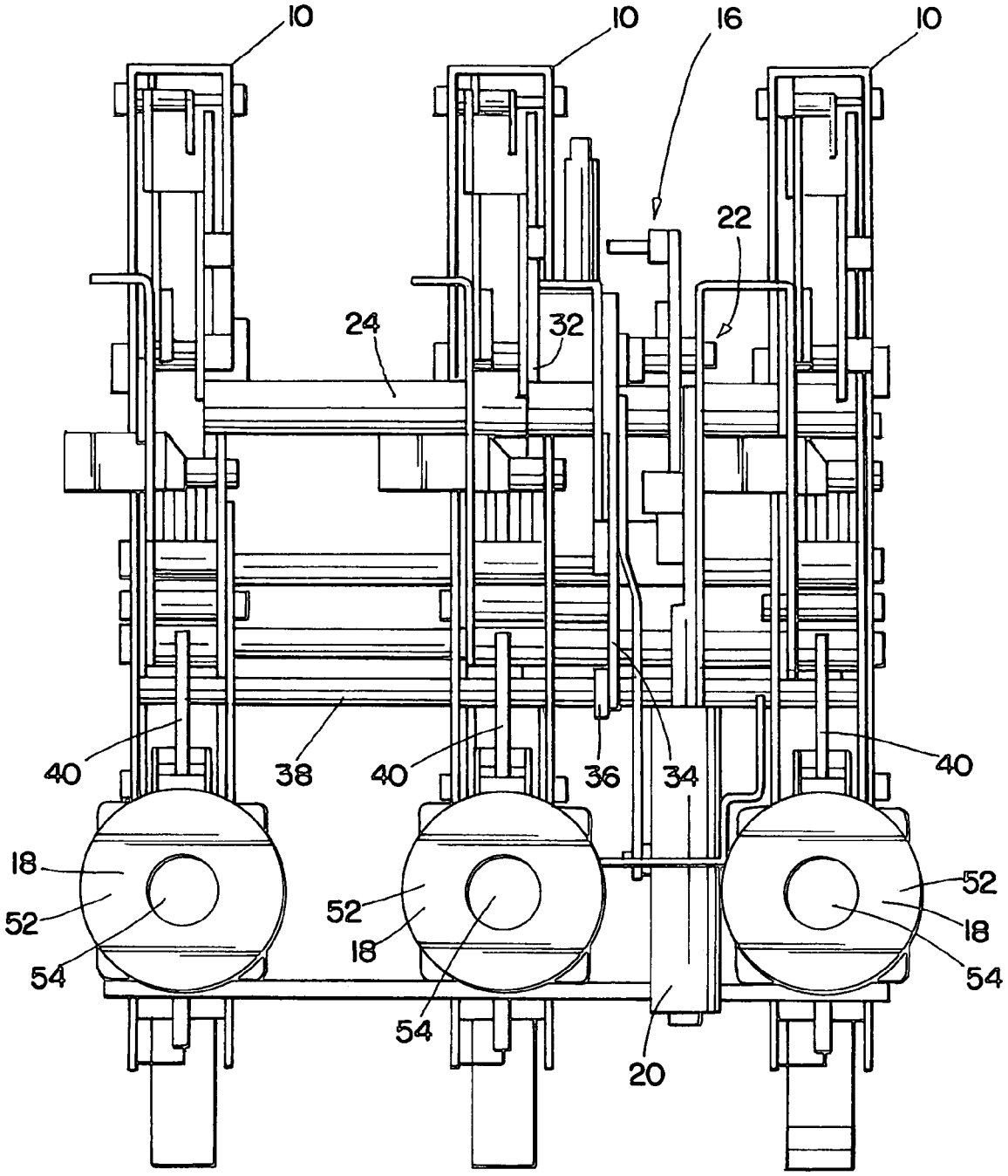
FIG. 2 front view of the assembly illustrated in FIG. 1.

FIGS. 1 and 2 illustrate a multi phase, e.g., three phases shown in FIG. 1, interrupting device 10 that incorporates for each phase a disconnect assembly 12 in series with a vacuum interrupter 14. Circuit interrupting occurs in the interrupter 14 followed by opening of the disconnect assembly 12 via a disconnect operating mechanism 16. Circuit making occurs via high speed closing of the interrupter 14 after closing of the disconnect 12. During operation of the disconnect 12, to open or to close or to ground, the interrupter 14 is tripped open, thus ensuring that closing of the disconnect 12 precedes closing of the interrupter. A magnetic actuator 18 operates the interrupter 14, which may include a spring assist arrangement, for opening and/or closing operation of the interrupter 14 to provide high speed making and breaking including load or fault closing consistent with the rated capacity of the interrupter 14.

The disconnect operating mechanism 16 may be of the type or similar to that described in commonly assigned U.S. Pat. No. 6,180,902, the disclosure of which is incorporated herein by reference. The disconnect operating mechanism 16 may be disposed between adjacent devices 10, and may include an energy source, such as a spring arrangement 20 that is coupled by way of a drive mechanism 22 to a rotating output shaft 24. An arm 26 corresponding to each disconnect assembly 12 is couple for rotation with the output shaft 24 and via a link 28 to a pivoting blade assembly 30. The drive mechanism 22 communicates stored energy from the spring arrangement 20 to rotationally drive the output shaft 24, which is translated by the arms 26 and links 28 into rotating/pivoting motion of the blade assemblies 30. The drive mechanism 22 may also include a suitable manual input for supplying a manually applied torque for moving the blades assemblies between their various states. In this regard, the structure and mechanism for driving the blade assemblies is typical; however, as will be explained, high speed make or break of the disconnect assemblies is not required. Therefore, the expected operating life of the drive mechanism 22 and the correspondingly driven blade assemblies 30 is increased.

A trip arm 32 is coupled to rotate with the shaft 24 and is coupled to a trip link 34 which, in turn, is coupled to a trip lever 36. Rotation of the shaft 24 causes pivoting motion of the trip lever 36 by way of the trip arm 32 and the trip link 34. The trip lever 36 rotationally drives a trip shaft 38. For each device 10, a trip cam 40 is secured to the trip shaft 38 for rotation therewith.

Figure 3:
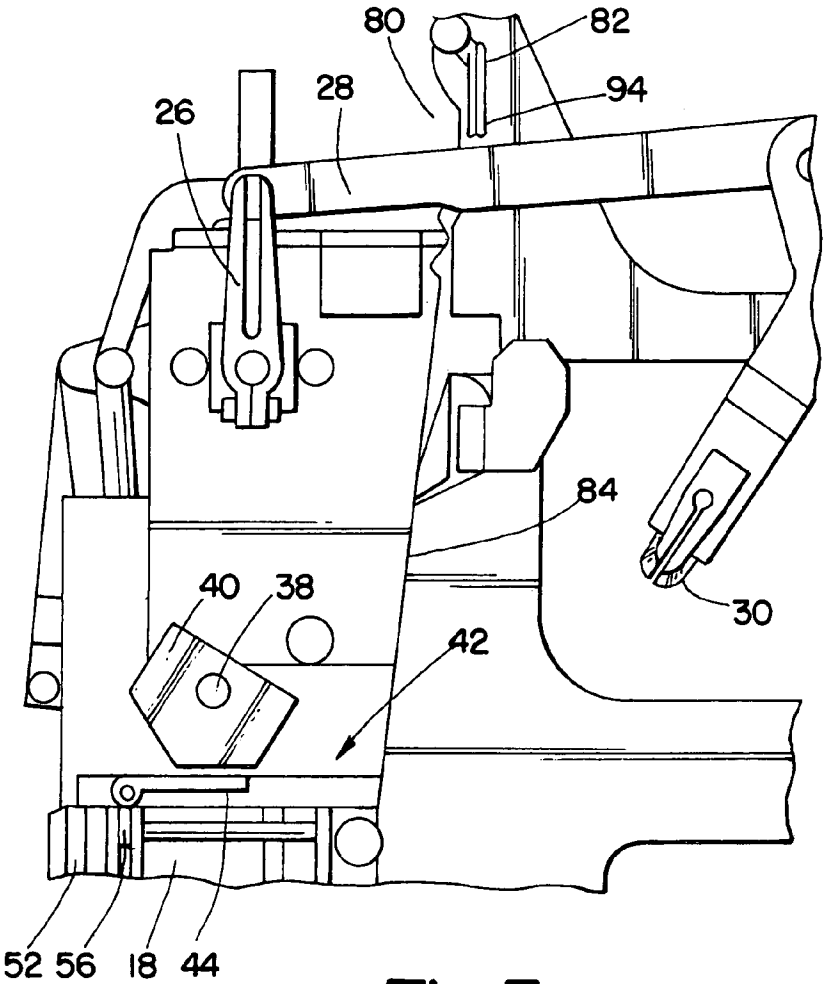
FIG. 3 is a partial side view of the assembly illustrated in FIG. 1.
Figure 5:
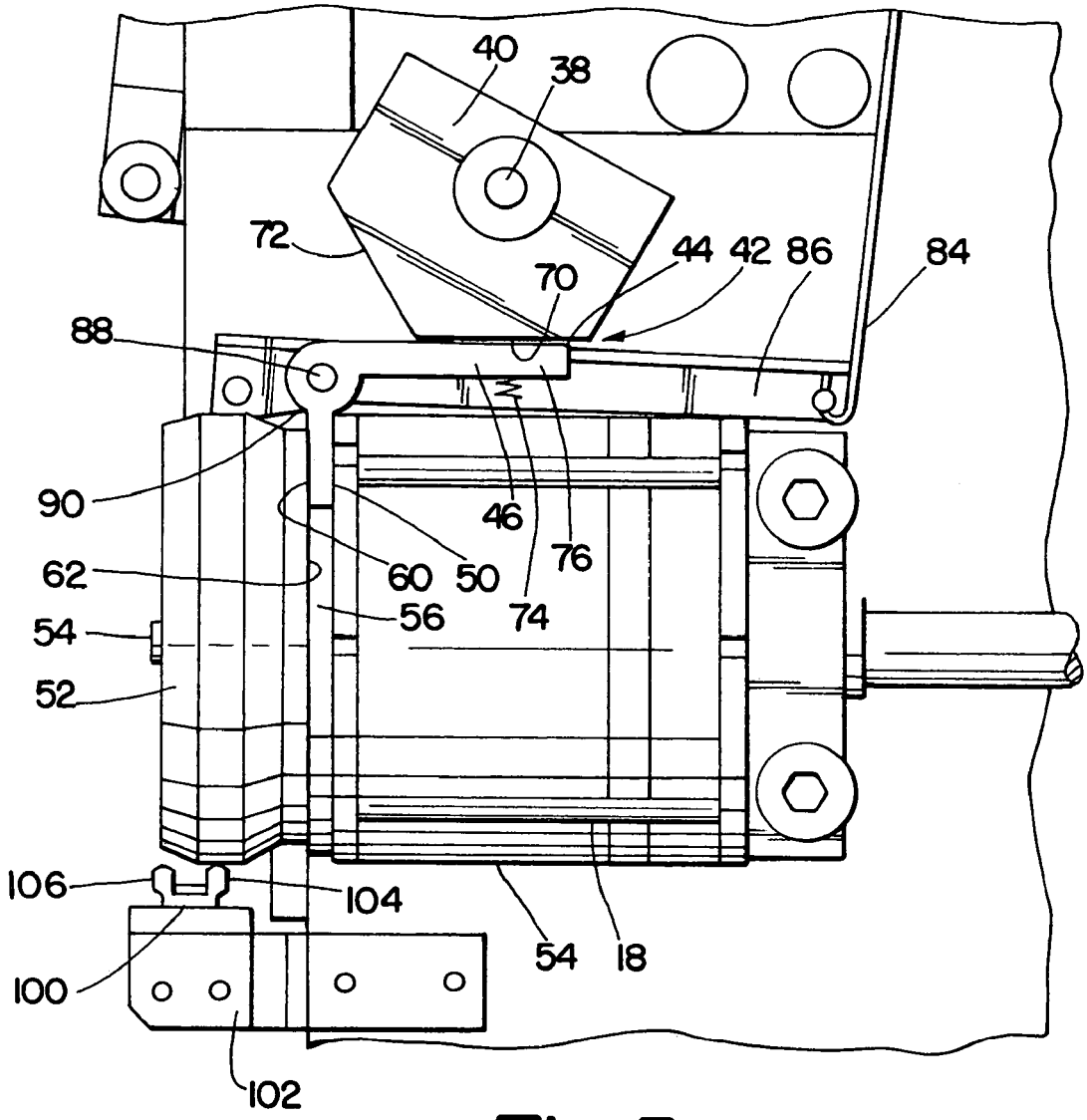
FIG. 5 is a further enlarged, partial side view of the assembly illustrated in FIG. 1.

FIGS. 3 and 5 illustrate the trip cam 40 and an associated interrupter trip mechanism 42 that is associated with each device 10. The interrupter trip mechanism 42 includes a trip plunger lever 44 that is mounted for pivoting motion to the device 10. The trip plunger lever 44 includes an actuation arm potion 46 including a contact surface 48 and an action arm portion 50. The trip plunger lever 44 is mounted adjacent the magnetic actuator 18, and particularly an end block 52 fixed to an actuator rod 54 of the magnetic actuator 18. The end block 52 is positioned on the actuator rod 54 to create a gap 56 between the end block 52 and a housing 58 of the magnetic actuator 18. The action arm portion 50 is disposed within the gap 56 with a drive surface 60 thereof contacting a driven surface 62 of the end block 52. Pivoting motion (clockwise as depicted in the figure) of the trip plunger lever 44 presses the drive surface 60 against the driven surface 62 thereby imparting an axial force on the end block 52. The axial force applied to the end block 52 results in linear translation of the end block 52 and the actuator rod 54. The actuator rod 54 is coupled through the magnetic actuator 18 to a moveable contact (not depicted) of the vacuum interrupter 14. The linear translation of the end block 52 and the actuator rod 54 as a result of pivoting motion of the trip plunger lever 44 therefore results in linear translation of the moveable contact separating it from a fixed contact within the vacuum interrupter 14 opening the vacuum interrupt 14.

Figure 4:
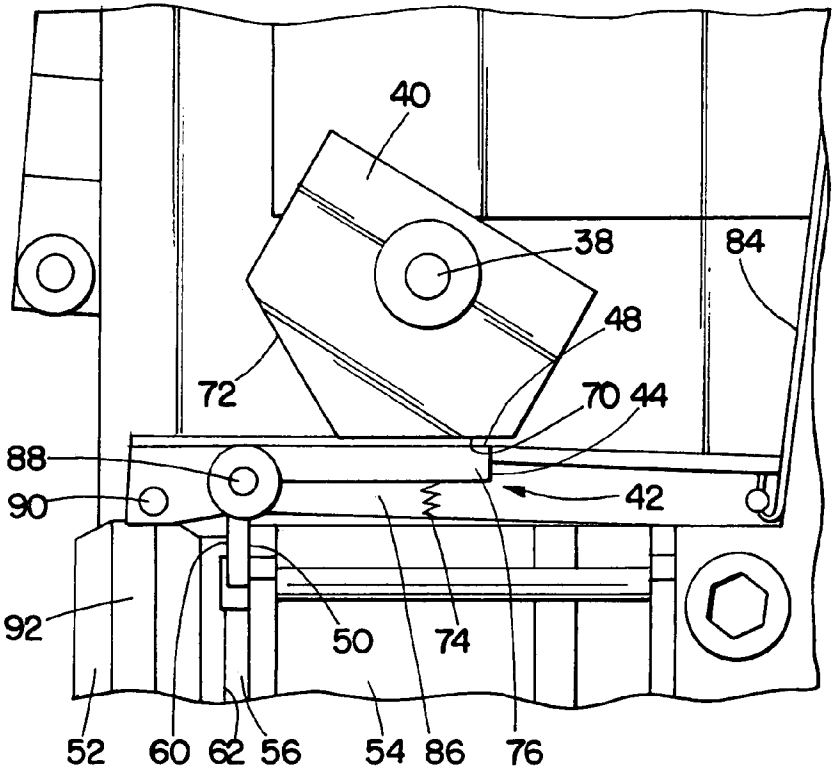
FIG. 4 is an enlarged, partial side view of the assembly illustrated in FIG. 1.

The trip cam 40 includes at least a first cam surface and may include one or more cam surfaces. As shown in FIG. 4, the trip cam 40 includes a first cam surface 70 and a second cam surface 72. The trip cam 40 is positioned with one of the cam surfaces, surface 70 as shown in FIG. 4, adjacent the contact surface 48. Rotation of the trip cam 40 (counter-clockwise as depicted in the figure) engages the surface 70 with the contact surface 48 causing rotation of the trip plunger lever 44, and subsequent opening of the vacuum interrupter 14 as described above. The contact surface 48 is biased against the trip cam 40 by a return spring 74 that bears against a surface 76 of the trip plunger lever 44.

Each device may further include a visual trip indicator assembly 80. A trip indicator 82 is mounted to the device 10 to pivot. A control wire 84 couples the trip indicator 82 to an indicator drive lever 86. The indicator drive lever 86 is mounted to the device to pivot, and as shown in FIGS. 3 and 4, the indicator drive lever 86 may share a pivot mount 88 with the trip plunger lever 44. The indicator drive lever 86 further includes a cam follower 90 that contacts a cam profile 92 formed on the end block 52. The cam follower 90 is biased against the cam profile 92. With linear displacement of the end block 52, the cam follower 90 follows the cam profile 92 causing the indicator drive lever 86 to pivot. The pivoting motion of the indicator drive lever 86 results in translation of the control wire 84 and subsequent rotation of the trip indicator 82. The trip indicator 82 thus pivots, i.e., rotates, such that an indicator arm portion 94 moves to a trip indication state (not depicted).

Figure 6:
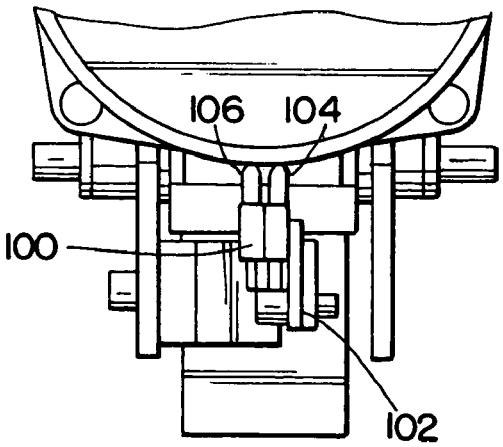
FIG. 6 is an enlarged, partial front view of the assembly illustrated in FIG. 1.

Referring to FIGS. 5 and 6, in addition to the visual trip indicator, electronic sensing may be provided to report the state of the magnetic actuator 18, and hence, the state of the associated vacuum interrupter 14. A limit switch 100 may be secured to a mounting bracket 102 adjacent the end block 52 and adjacent the cam profile 92. The limit switch may have a first pickup 104 and a second pickup 106. The pickups 104 and 106 may be non-contact proximity detectors, may be mechanical contacts or any suitable switch type. With the magnetic actuator 18 in a contact closed state, the first pickup 104 is adjacent a surface 108 of the cam profile 92 and reports the position of the magnetic actuator 18 to a suitable control element (not depicted). When the magnetic actuator 18 is in a contact open state, either by operation of the magnetic actuator 18 or by action of the interrupter trip mechanism 42, the second pickup 106 is adjacent the surface 108 and reports the position of the magnetic actuator 18, and hence the state of the vacuum interrupter 14.

Figure 7:
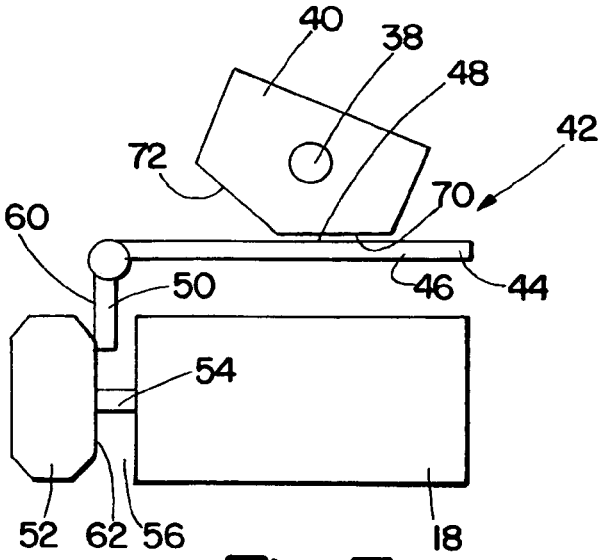
FIGS. 7-10 are schematic illustrations of the operation of a fault interrupting and disconnect mechanism in accordance with a described embodiment.
Figure 8:
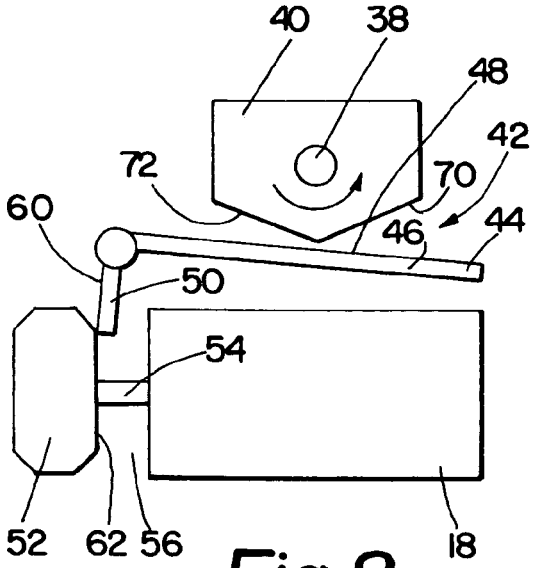
Figure 9:
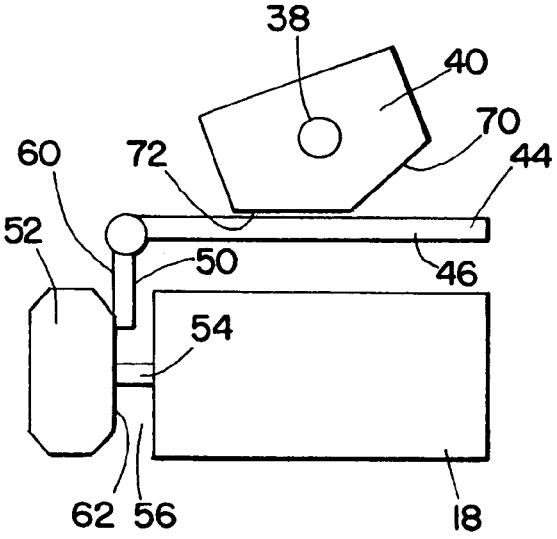
Figure 10:
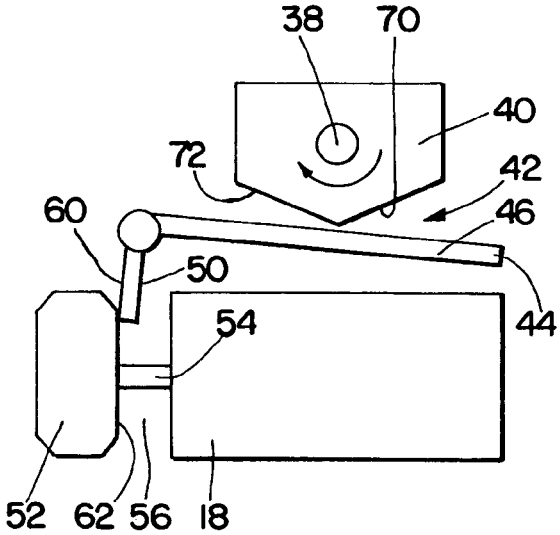

FIGS. 7-10 depict schematically several but not all possible operating states of the magnetic actuator 18 and the interrupter trip mechanism 42. FIG. 7 depicts the magnetic actuator 18 in the contacts closed state and the disconnect assembly 12 also in the closed state. The cam surface 70 is adjacent the surface 48. Actuation of the disconnect operating mechanism 16, and hence the drive mechanism 22 to cause the blade assembly to move from the contact closed state to the contact open state results first in rotation of the cam 40 (counter-clockwise as depicted in FIG. 8). The cam surface 70 engages the contract surface 48 causing pivoting of the trip plunger lever 44 to translate the end block 52 and actuating rod 54 of the magnetic actuator 18 to open the vacuum interrupter 14 contacts. The rotation of the cam 40 and the timing of the drive mechanism 22 are such that the vacuum interrupter 14 contacts are first opened before the blade assemblies 30 disengage associated contacts. With the disconnect assembly 12 open, i.e., the blade assemblies 30 rotated to an open position, the cam 40 is positioned such that surface 72 is now adjacent the trip plunger lever 44. The return spring 74 biases the trip plunger lever 44 against the cam surface 72. The magnetic actuator 18 may act to reclose the vacuum interrupter contacts 14 (as depicted in FIG. 9), or it may remain in an open state (not depicted). Actuation disconnect operating mechanism 16 to cause the blade assembly 30 to move from the open state to the closed state first results in rotation of the cam 40 (clockwise as depicted in FIG. 10). The cam surface 72 engages the contact surface 48 contract surface 48 causing pivoting of the trip plunger lever 44. If the magnetic actuator 18 has closed the vacuum interrupter contacts 14, pivoting of the trip plunger lever 44 causes translation of the end block 52 and actuating rod 54 of the magnetic actuator 18 to open the vacuum interrupter 14 contacts. The rotation of the cam 40 and the timing of the drive mechanism 22 are such that the vacuum interrupter 14 contacts are first opened before the blade assembly 30 engages associated contacts. With the disconnect assembly 12 closed, i.e., the blade assembly 30 is rotated to a closed position, the cam 40 is positioned such that surface 70 is now adjacent the trip plunger lever 44. The return spring 74 biases the trip plunger lever 44 against the cam surface 70. The magnetic actuator 18 may now act to reclose the vacuum interrupter 14 contacts (as depicted in FIG. 7), or it may remain in an open state.

As will be appreciated, operation of the disconnect assembly 12 is proceeded by opening of the vacuum interrupter 14 contacts. Thus, the blade assemblies are not required to open or close load or fault current reducing wear on the blade assemblies. Moreover, the disconnect operating mechanism 16 is not required to provide high speed opening or closing of the blade assemblies, but may still do so to reduce operating time. High speed opening and closing of either load or fault current occurs within the vacuum interrupter 14 by operation of the magnetic actuator 18. The interrupter trip assembly may be configured such that the cam 40 provides a plurality of cam surfaces to control the state of the vacuum interrupter 14 contacts, opened or closed, based upon the present or intended operation and state of the disconnect assembly 12.

While the present disclosure is susceptible to various modifications and alternative forms, certain embodiments are shown by way of example in the drawings and the herein described embodiments. It will be understood, however, that this disclosure is not intended to limit the invention to the particular forms described, but to the contrary, the invention is intended to cover all modifications, alternatives, and equivalents defined by the appended claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning. Unless a claim element is defined by reciting the word "means" and a function without the recital of any structure, it is not intended that the scope of any claim element be interpreted based on the application of 35 U.S.C. §112, sixth paragraph.

We claim:

1. A fault interrupter and disconnect device comprising:

a vacuum interrupter coupled in series with a disconnect assembly, the vacuum interrupter having an open state and a closed state, the disconnect assembly having an open state and a closed state;

an actuator coupled to the vacuum interrupter to place the vacuum interrupter in either the open state or the closed state;

a disconnect operating mechanism coupled to the disconnect assembly to place the disconnect assembly in either the open state or the closed state; and a vacuum interrupter trip mechanism including a member coupled to the disconnect operating mechanism and moveable with the disconnect operating mechanism, the member further being coupled to the vacuum interrupter such that upon operation of the disconnect operating mechanism to place the disconnect assembly in the open state or to place the disconnect assembly in the closed state, the member engages the vacuum interrupter to place the vacuum interrupter in the open state before a change of state of the disconnect assembly.

2. The device of claim 1, the disconnect operating mechanism comprising a rotateable shaft, rotation of the rotateable shaft moving the member to engage the vacuum interrupter.

3. The device of claim 1, the member being coupled to the vacuum interrupter via the actuator.

4. The device of claim 3, the member engaging an actuator rod of the actuator, the actuator rod being coupled to the vacuum interrupter.

5. The device of claim 4, the member comprising a cam, the cam engaging a lever and the lever engaging the actuator rod.

6. The device of claim 4, the cam having a first cam surface and a second cam surface, the first cam surface engaging the lever upon operation of the disconnect operating mechanism to place the disconnect assembly in the open state and the second cam surface engaging the lever upon operation of the disconnect operating mechanism to place the disconnect assembly in the closed state.

7. The device of claim 1, comprising a visual indicator indicating the state of the vacuum interrupter, the visual indicator being coupled to the member for movement with the member from a first indicating state to a second indicating state, the first and second indicating states corresponding to the open state of the vacuum interrupter and the closed state of the vacuum interrupter, respectively.

8. The device of claim 1, comprising a limit switch assembly, the limit switch positioned with respect to the actuator to report a position of the actuator corresponding either the open state or the closed state of the vacuum interrupter.

9. A circuit or fault interrupting and disconnect device, the device comprising:

a vacuum interrupter and a disconnect assembly; and an interrupter trip mechanism coupled to the disconnect assembly and the vacuum interrupter, the interrupter trip mechanism operable to open the vacuum interrupter upon initiation of a change of state of the disconnect assembly from either an open state to a closed state or from a closed state to an open state.

10. The device of claim 9, the disconnect assembly comprising a blade assembly and a drive mechanism coupled to the blade assembly to move it to its various states, the drive mechanism coupled to the interrupter trip mechanism to open the vacuum interrupter prior to the blade assembly making or breaking contact.

11. The device of claim 10, comprising a visual indicator indicating the state of the vacuum interrupter, the visual indicator being coupled to the interrupter trip mechanism for movement with the interrupter trip mechanism from a first indicating state to a second indicating state, the first and second indicating states corresponding to the open state of the vacuum interrupter and the closed state of the vacuum interrupter, respectively.

12. The device of claim 9, the interrupter trip mechanism being coupled to the vacuum interrupter via an actuator associated with the vacuum interrupter.

13. The device of claim 12, the interrupter trip mechanism engaging an actuator rod of the actuator, the actuator rod being coupled to the vacuum interrupter.

14. The device of claim 13, the interrupter trip mechanism comprising a cam, the cam engaging a lever and the lever engaging the actuator rod.

15. The device of claim 14, the cam having a first cam surface and a second cam surface, the first cam surface engaging the lever upon a change of state of the disconnect assembly from the open state and the second cam surface engaging the lever upon a change of state of the disconnect assembly from the closed state.

16. The device of claim 1, the disconnect assembly comprising a blade assembly and a drive mechanism coupled to the blade assembly to move it to its various states, the drive mechanism coupled to the interrupter trip mechanism to open the vacuum interrupter prior to the blade assembly making or breaking contact.

* * * * *